US006928762B1

(12) United States Patent
Fattahi

(10) Patent No.: US 6,928,762 B1
(45) Date of Patent: Aug. 16, 2005

(54) FRAMING SYSTEM

(76) Inventor: Marc Mehrdad Fattahi, 47 Mathews St., Stamford, CT (US) 06902

( * ) Notice: Subject to any disclaimer, the term of this patent is extended or adjusted under 35 U.S.C. 154(b) by 344 days.

(21) Appl. No.: 09/664,010

(22) Filed: Sep. 18, 2000

Related U.S. Application Data

(63) Continuation-in-part of application No. 09/270,818, filed on Mar. 18, 1999, now abandoned.

(51) Int. Cl.[7] ..... A47G 1/08
(52) U.S. Cl. ..... 40/741; 40/782
(58) Field of Search ..... 40/741, 742, 783, 40/782, 784, 785

(56) References Cited

U.S. PATENT DOCUMENTS 838,816 A * 12/1906 Sherwood ..... 40/741
1,091,245 A * 3/1914 Reid ..... 40/741

* cited by examiner

*Primary Examiner*—Cassandra H. Davis

(57) ABSTRACT

A fillet sub-framing system for art work is disclosed. The system includes four right-angled brackets and four lengths of fillet. Each bracket has two arms forming exteriorly open envelopes flexibly configured to accept the end portion of a fillet. Together the brackets and fillets form a rectangular sub-frame which may be used in combination with a conventional frame and matte to decoratively set-off art work.

17 Claims, 7 Drawing Sheets

FRAMING SYSTEM

This application is a continuation-in-part of abandoned application Ser. No. 09/270,818 filed on Mar. 18, 1999.

BACKGROUND OF THE INVENTION

The present invention relates to decorative framing systems and, more particularly, to systems including a fillet sub-framing system for art work such as a picture or painting.

Generally, a decorative framing system starts with a standard frame. Such frames are usually composed of wood or metal and form a rectangular surround or perimeter bordering the system.

Commonly, decorative framing systems also include a matte. This is an essentially two dimensional, rectangular sheet of a material such as heavy paper stock which is directly interior of a standard, surround frame. The matte contains an opening which is also usually rectangular. This produces a matte border which sets the picture away from the standard frame.

Standard frames surrounding art work have long been enhanced through the use of fillet sub-frames. These usually rectangular sub-frames are concentrically situated interior of the standard frames and are usually directly adjacent to both the matte and the art work being framed. A fillet sub-frame added to the interior edge of the matte opening supports the matte and/or completes this system.

Conventionally, fillet sub-frames have been made in much the same manner as standard, surround frames. Thus, lengths of fillet have been manufactured from wood or other rigid material, their ends being mitered and affixed together to form an open rectangle which matches the interior edge of the matte opening. Because much of both surround frames and fillet sub-frames are open to view, great care must be taken during their manufacture to avoid imperfections.

The exposed fillet lengths from which the sub-frames are made are often decorated themselves. This may be accomplished by embossing or profiling the surface of the fillet which will be exposed to view, painting that surface or any combination thereof. This decoration may make the avoidance of imperfections even more important for these sub-frames.

The most critical step in making a fillet sub-frame has heretofore resided in precisely and cleanly mitering the two ends of each length of fillet. Unless the ends of all four lengths of fillet are precisely fitted together, the sub-frame will not be rectangular and/or fit the interior opening of the matte. Further, unless each miter is cleanly made without chipping, that length of fillet should be discarded.

Other problems may also occur during production of conventional fillet sub-frames. Thus, for example, excess glue or manual handling may mar the exposed surface of the fillet. These problems again usually require replacement of one or more lengths of fillet.

The difficulties of making fillet sub-frames have contributed heavily to the expense of such decorative frame systems. These sub-frames have essentially all been made individually and by hand. Normally, even the most expert framers usually need at least a half hour of time to produce each sub-frame. Where problems arise requiring correction during production, much longer times result.

SUMMARY OF THE INVENTION

The present invention greatly facilitates the production of fillet sub-frames. It includes corner-connectors for paired lengths of fillet. The corner-connector comprises a bracket with two open-faced arms joined generally at a right angle. Viewed in cross-section, each arm forms a flexible envelope which is open obtusely of the angle formed by the bracket arms. The inside of the envelope is configured to conform with and hold the interior surfaces of the end portions of two fillets which would otherwise be exposed to view.

In a rectangular frame system, the fillet sub-frame is composed of four corner-connectors and two paired sets of fillet lengths. In contrast to the prior art means of production, however, these eight pieces are also much more readily joined together into a completed sub-frame.

Normally, the lengths of fillet are much longer than the arms of the brackets. Each arm is usually only 1 to 5 centimeters long. Desirably, each length of fillet is at least 6 and preferably at least 10 times as long. As a result, the normally exposed surface of the fillet remains the dominant portion of the sub-frame system.

Because the bracket has open-faced arms which are flexible and configured for a fillet, the end portion of a fillet is readily inserted into each bracket arm. The fillet remains slidingly engaged within an arm. This facilitates making a sub-frame of the desired size. Once a rectangular sub-frame has been roughly assembled, it can simply be reduced in size by sliding the fillets within the arms to what is required to exactly fit a given matte.

For example, the end portions of each length of fillet can be snapped into the outer centimeter of three centimeter long bracket arms. In this manner, a rectangular sub-frame which is about one centimeter larger than the corresponding dimensions of the interior opening in a matte can be made. The sub-frame may then be slidingly reduced in size to exactly match the dimensions of the matte opening.

Similarly, a single arm may be employed intermediate to adjacent brackets. Such an arm can, for example, be utilized to splice together two fillet segments effectively creating a longer length of fillet. Thus the ends of the two segments may be inserted into the two opposing open ends of the arm, thereby joining the two segments over a common axis.

As is evident from these examples of the present invention, the adjacent end portions of two lengths of fillet held by a given bracket or arm need not meet. Those ends are held within the envelope formed by the arms of the bracket and remain hidden from view. Thus, fillet lengths may be shorter than the corresponding dimensions of the sub-frame and it also becomes unnecessary to miter or otherwise finish their ends as the prior art requires.

In accordance with the features of the present invention, a sub-frame which precisely fits a matte and/or art work can be made both easily and quickly. One merely needs to cut four lengths of fillet which are somewhat shorter than the corresponding dimensions of the ultimate sub-frame. These lengths are inserted into the arms of the four brackets and then slid into the desired configuration. This configuration is normally sized so that the matte is supported on the forward surface of the exterior portion of the fillet.

Because the importance of sizing, cutting, matting and gluing, etc. thefillet lengths is greatly reduced in accordance with the present invention, errors in production are minimized. In practical terms, this means that an essentially perfect fillet sub-frame can be made by almost anyone in a one-quarter or less of the time previously required by an expert framer. This also greatly reduces their cost.

These and other objects and advantages of the present invention will become apparent upon review of specifications and drawings which follow.

DETAILED DESCRIPTION AND SPECIFICATION

Figure 1:
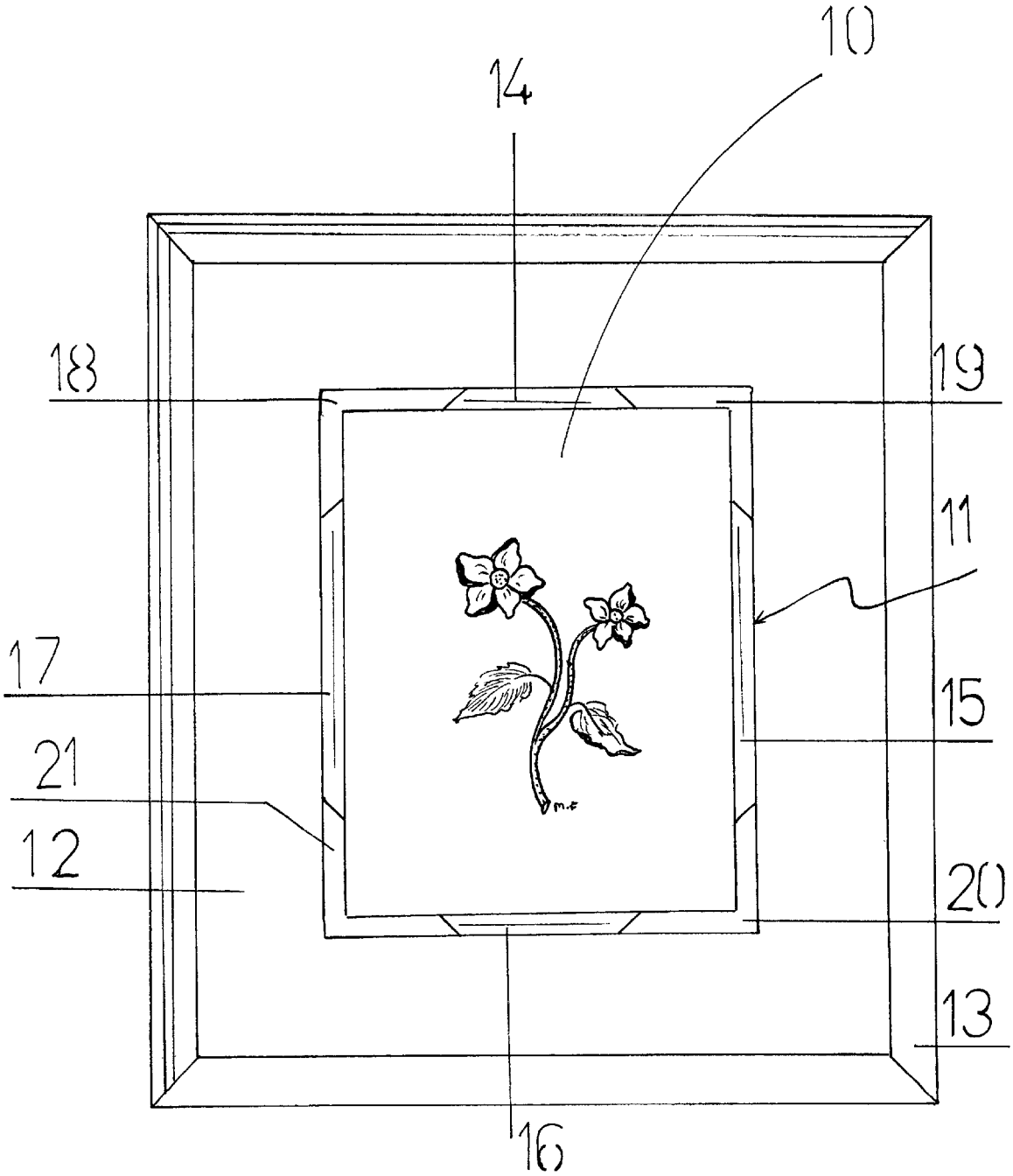
FIG. 1 is a front elevational view of a frame system constructed in accordance with the present invention.

The present invention is seen generally in context in FIG. 1. There, a picture 10 is shown encompassed sequentially by an inner fillet sub-frame 11, a matte 12 and a surrounding frame 13. The sub-frame 11 is shown as being composed of lengths of fillet 14, 15, 16 and 17 joined by right-angled corner-connectors 18, 19, 20 and 21.

The corner-connectors may be formed in a variety of conventional ways. Most simply, they may be cast of plastic material and cured in the form described here and/or below. Another means of formation involves extrusion of, for example, metal arms. After first passing the metal through an appropriate die, the extrudate may be cut and/or mitered into appropriately sized arm sections. A pair of these arm sections is then joined at a right angle to form the bracket.

Figure 2:
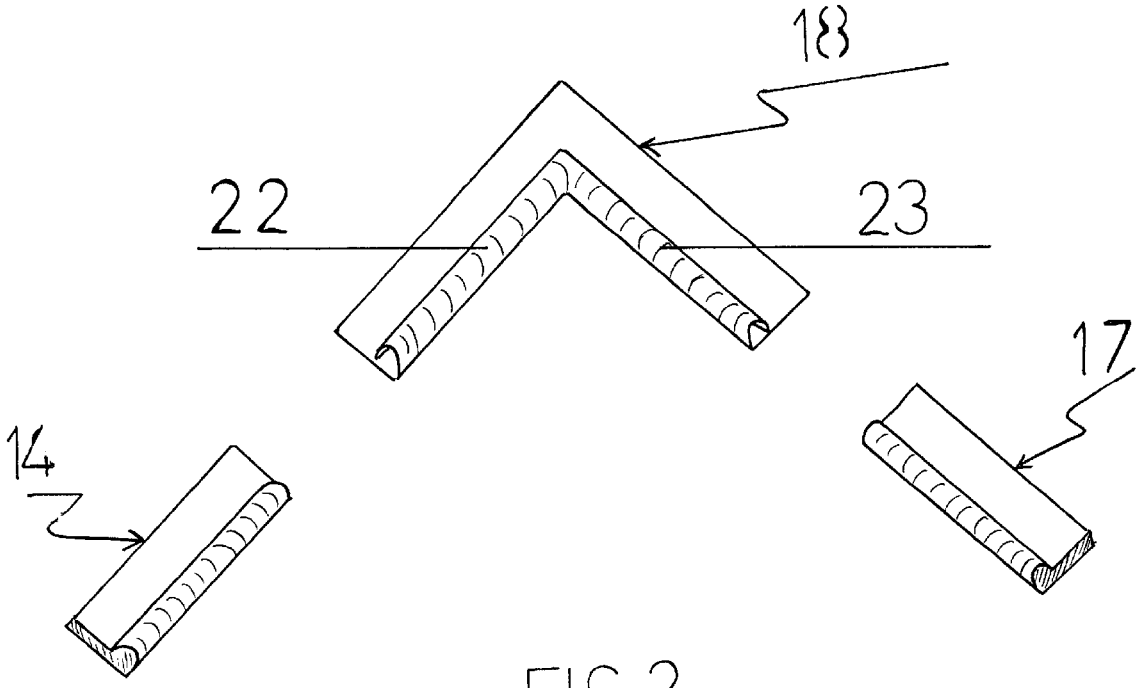
FIG. 2 is an exploded, fragmentary front view of corner-connector and fillet members aligned for assembly.

In FIG. 2, the alignment of a corner-connector 18 and lengths of fillet 14 and 17 is depicted. The two lengths of fillet are shown a short distance from the two arms 22 and 23 of the corner-connector. Incident assembly, both lengths of fillet are slid along their axes, part-way into the respective and correspondingly aligned arms. Later, when the corner-connector and fillet lengths are set within the opening of the matte (not shown), the lengths of fillet may be slid or inserted further into the arms to fit the matte perfectly.

Figure 3:
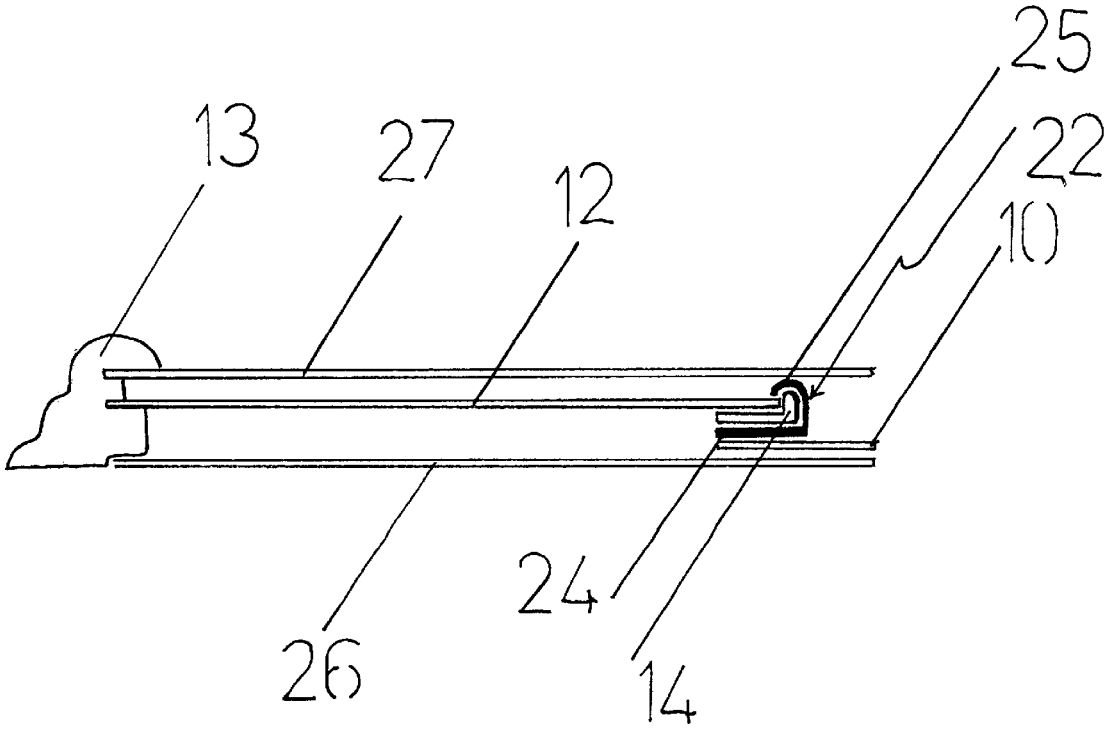
FIG. 3 is an exploded, fragmentary cross-sectional view of a typical frame/matte/sub-frame system of the present invention.

In FIG. 3, a cross-sectional view of a completed frame/matte/sub-frame system for a picture is depicted. Directly overlapping the perimeter of the picture 10 is an arm 22 of a corner-connector (not shown in its entirety). The arm 22 forms an open envelope composed of a continuous sheet of material configured with an essentially planar rear strip 24 and a contoured strip 25.

As depicted, the rear strip 24 extends along about half of the width of the adjacent fillet 14 occupying the space or pocket within the envelope of the arm 22. Although not necessary, glue may be applied between the contiguous surfaces of the fillet 14 and arm 22 during assembly to ensure that no movement will later occur.

The contoured strip 25 extends forward and exteriorly from the interior edge (or end) of said rear strip 24, to configure tightly to the end portion of the exposed or visible surface of the fillet 14. Because of the one-piece construction of the contoured and rear strips from a flexible material such as metal or plastic, they form an open envelope which flexibly expands to accept and then contracts to hold the fillet.

Once assembled, as depicted, the two strips 24 and 25 of an arm 22 hold the fillet 14 within (or inside) their envelope. Although not necessary, the forward (or exterior) edge of the contoured strip 25 may extend beyond the raised interior portion of the fillet, as shown, a short distance over the interior edge of the matte 12. In this preferred embodiment, any slight failure(s) of matching between adjacent edges of the matte 12 and fillet 14 supporting same are hidden from view. Further, this overlapping extension will prevent the adjacent edge of the matte from lifting or moving forward of the fillet. This is especially desirable where (as shown) no glue has been applied between contiguous surfaces of the matte 12 and fillet 14.

A distance exteriorly removed from the fillet 14 is the outer or surround frame 13. Shown attached to the surround frame is an optional backing sheet 26. This sheet of wood, press board or the like may extend across the entire area behind the picture 10 to enhance the physical integrity of the frame system.

Also depicted, although optional, is a sheet of glass (or other transparent material) 27. This conventional framing element usually extends fully between the interior surfaces of the surround frame 13 and is employed to protect the picture 10 as well as other elements of the system which are exposed to view. Additionally, it too enhances the physical integrity of the framing system.

Figure 4:
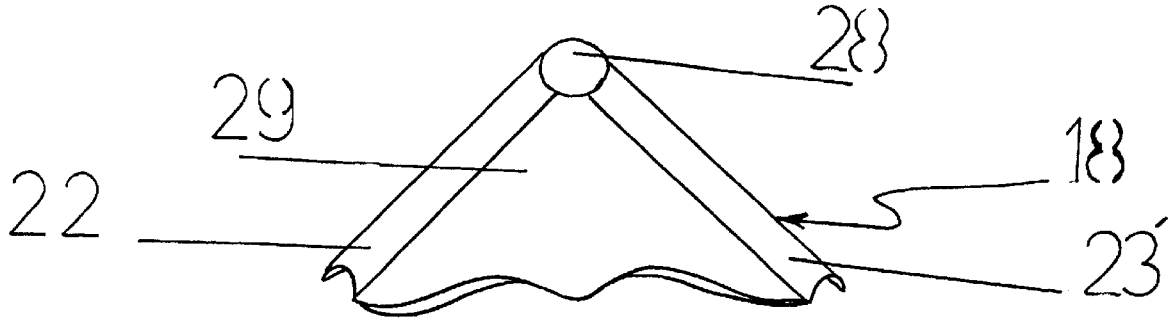
FIG. 4 is a front elevational view of a preferred, ornamental corner-connector of the present invention.

FIG. 4 depicts a preferred corner-connector bracket of the present invention. As previously described, the bracket 18 is composed of two arms 22 and 23'. Those are joined at a right-angle by attachment to a central corner piece 28, here shown as a sphere to which the bracket arms may be fused. In this embodiment, the pocket of space within the normally continuous envelope formed by the arms of a bracket is subdivided by the central corner piece 28.

Suspended between the arms 22 and 23' and substantially parallel to the frame system is an ornamental corner member 29. As shown, this member comprises a simple drape-like sheet of essentially two dimensional material. This member may be composed of the same material as the bracket and, where affixed or united along both arms as shown, may further increase the structural integrity of the framing system.

Where substantially as shown, with or without variation in shape, the corner member 29 is exposed to view and may also serve as a surface upon which an applique, embossed motif or other decoration may be placed. Thus, this optional aspect of this invention may also be employed to increase the ornamental nature of a framing system.

Figure 5:
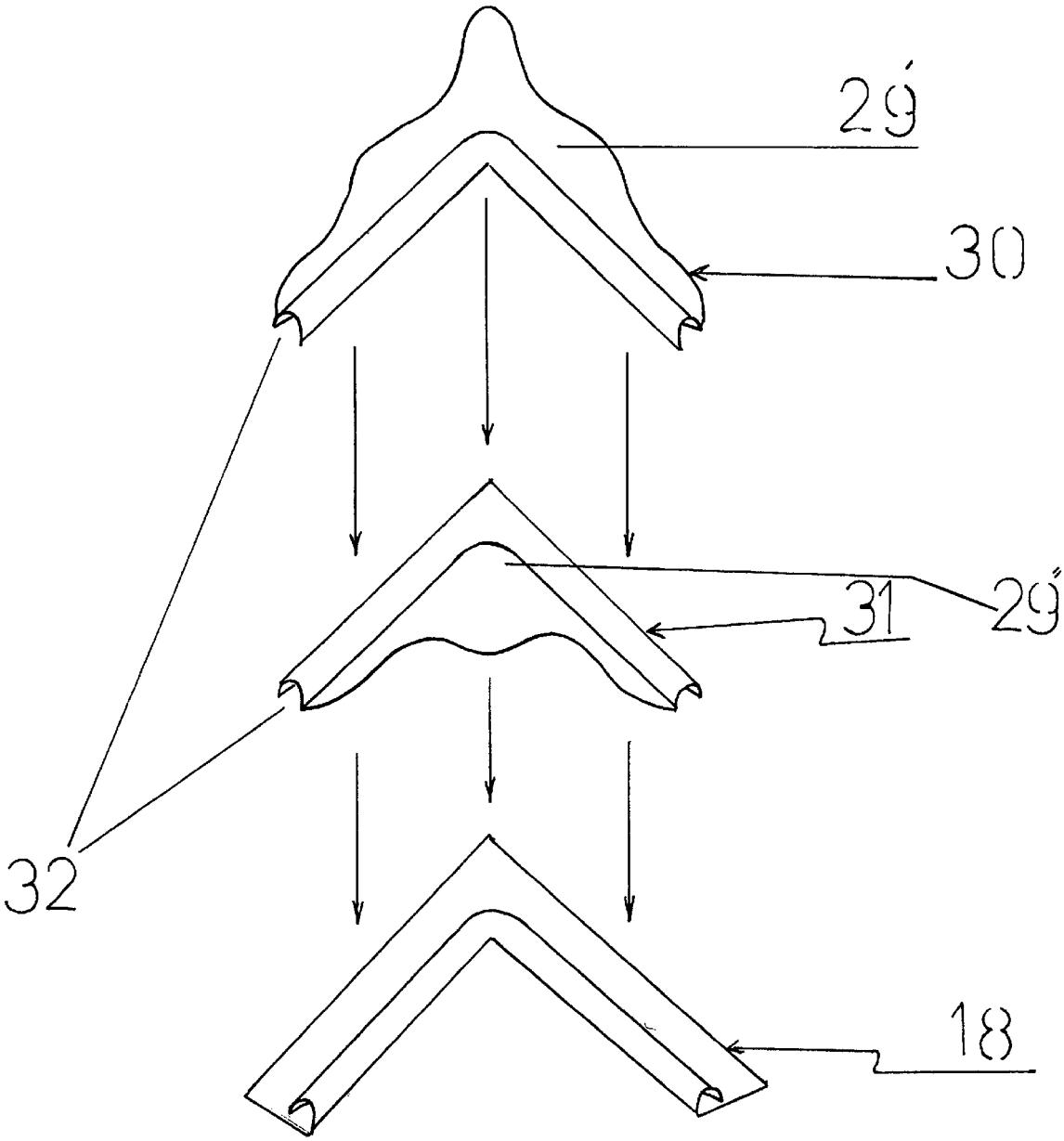
FIG. 5 is a front elevational view of two preferred, ornamental covers for corner-connectors of the present invention.

FIG. 5 depicts still a further preferred embodiment of this invention involving alternative decorative and/or strengthening covers 30 or 31 for a corner-connector 18 constructed as previously described. Either of representative covers 30 or 31 may be employed. The wall of cover 30 or 31 is contoured to form a J-shaped trough 32 forming a right angle. The opposing sides of the wall of the trough 32 match the corresponding sides of the exterior or exposed surface of the corner-connector 18.

Projecting from the trough walls of the cover 30 or 31 is a corner member 29' or 29" of drape or fan-like appearance, respectively. Such members are largely ornamental and may, as previously described, have virtually any shape. Again, they are normally composed of substantially two-dimensional sheets of material attached laterally of the corner member and parallel with the frame system.

A cover may be affixed over the exposed surface of any of the corner-connectors of this invention. The trough of this cover is constructed in the same way as previously described for the arms of a corner connector. Where made of a flexible material such as plastic, it can simply be forced onto the corner-connector and held in place by the pressure exerted by its flexible walls against the corner-connector. It can, of course, also be glued onto the corner-connector. The cover may be used to enhance the appearance of a fillet sub-frame and/or harmonize the framing system with the art work displayed within it.

Figure 6:
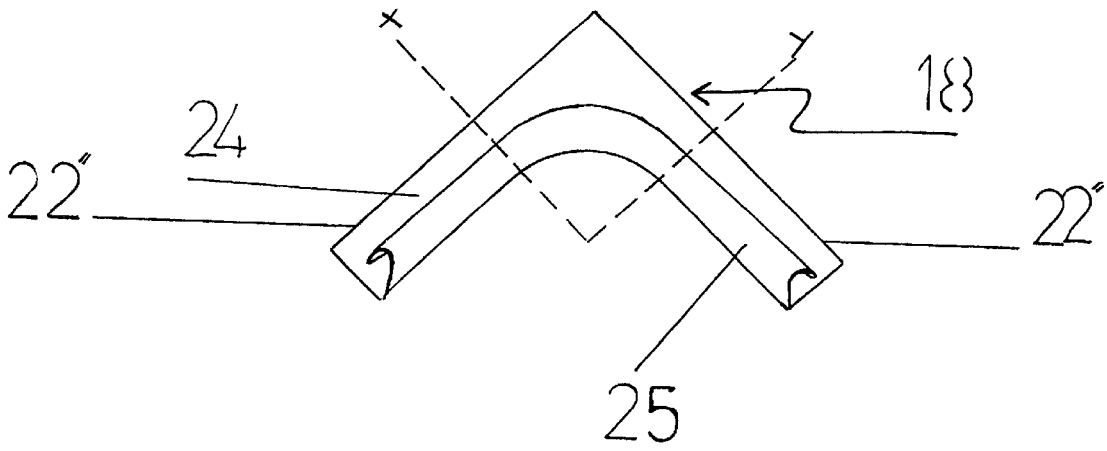
FIG. 6 is a front elevational view of a preferred corner-connection of the present invention.

FIG. 6 depicts another preferred corner-connector bracket of the present invention. The bracket 18 has two arms 22" and 22". Each arm is composed of a planar rear strip 24 and a contoured strip 25 extending forward and exteriorly from the interior edge of the rear strip 24 as previously described.

The two arms 22" and 22" are maintained a distance apart at a right angle. The adjacent ends of the arms are joined through a central corner piece comprising an arc portion of contoured strip (the section of the bracket between axes X an Y). Desirably, the rear strips of each of the arms extend beyond the arc portion and are also united to form a planar surface. In this embodiment, the fillets (not shown) are as usually inserted into the bracket arms 22" and 23" no further than the distances depicted by the axes X and Y.

The combination of four of the brackets of this embodiment connected through four fillets creates a unique inner fillet sub-frame (compare with the sub-frame 11 of FIG. 1) characterized by rounded corners. This sub-frame may be employed to set-off a picture, photograph or other art work in a manner which has heretofore been impossible utilizing conventional fillets.

Figure 7:
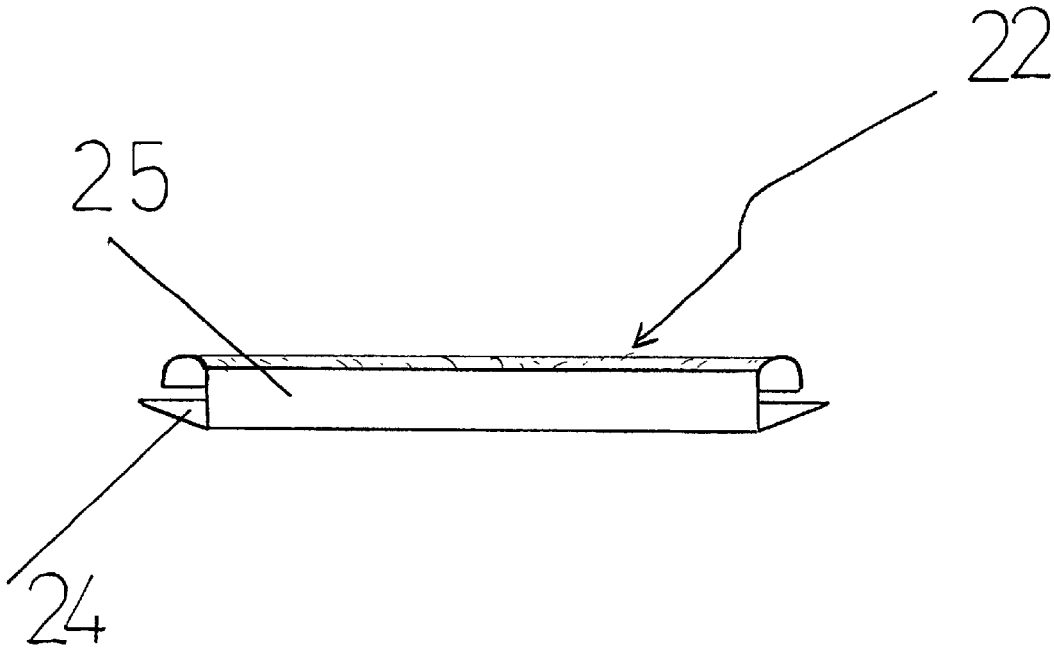
FIG. 7 is a front elevational view of a connector of the present invention.

FIG. 7 depicts an arm section 22" open at both ends, which may be employed with the brackets of the present invention. This arm section is composed of a planar rear strip 24 and contoured strip 25 cross-sectionally forming a flexible envelope as otherwise previously described.

A straight arm section such as this embodiment may be employed for a variety of purposes in accordance with this invention. It may be utilized to essentially splint the ends of two fillets to form a side of an inner fillet sub-frame. Thus, for example, the broken ends of a fillet can be joined within an arm section. Similarly, an arm section can be placed around a fillet, ordinarily a distance apart from a bracket such as at a fillet mid-point, either for esthetic reasons and/or to permit increased support of the fillet through an ancillary means of attachment to the matte.

It is to be understood that the present invention is not limited to the, specific, representative embodiments described above. Instead, this invention encompasses any and all embodiments within the scope of the claims which follow.

What is claim is:

1. A fillet corner-connector system for a decorative frame comprising a bracket having two open-faced arms joined at an essentially right angle, each arm cross-sectionally forming a flexible envelope comprising an essentially planar rear strip and a contoured strip extending forward and exteriorly from an interior edge of said rear strip wherein each envelope opens away from said right angle and is configured to conform with and hold an end portion of a fillet.

2. The system of claim 1, wherein the fillet comprises an exterior portion suitable for rear support of a matte and an interior portion raised forward of said rear support.

3. The system of claim 2, wherein the forward edge of the contoured strip extends beyond the raised interior portion of the fillet so as to be capable of overlapping a matte supported on the forward surface of the exterior portion of the fillet.

4. The system of claim 3, wherein the bracket arms are joined by afixture to a central corner piece to form the right angle.

5. The system of claim 4, which the central corner piece sub-divides the envelope into two separate portions attendant each bracket arm.

6. The system of claim 4, wherein the central corner piece comprises an arc portion of the contoured strip, said portion joining the two bracket arms.

7. The system of claim 6, wherein the rear strips of each of the two bracket arms extend beyond the arc portion, uniting to form a planar surface.

8. The system of claim 3, wherein a corner member is suspended between the bracket arms.

9. The system of claim 2, wherein the bracket is connected with three additional and identical brackets by fillets to form a rectangular fillet sub-frame.

10. The system of claim 9, wherein one of the arms open at both ends is affixed over a fillet.

11. The system of claim 1, wherein a cover comprising a J-shaped trough formed into a right angle is affixed over a forward surface of the corner-connector, said trough bearing an essentially two dimensional corner-member extending laterally therefrom.

12. The system of claim 1, wherein the rear strip and contoured strip form a continuous sheet.

13. The system of claim 12, wherein the sheet is composed of flexible material whereby the envelope expands to accept and contracts to hold the fillet.

14. A fillet corner-connector system for a decorative frame comprising a bracket having two open-faced arms joined at an essentially right angle, each arm cross-sectionally forming an envelope which opens away from said right angle and comprises a continuous sheet of flexible material whereby the envelope expands to accept and contracts to hold a fillet.

15. The system of claim 14, wherein the envelope comprises an exterior portion suitable for rear support of a matte and an interior portion raised forward of said rear support.

16. The system of claim 15, wherein the bracket arms are joined by afixture to a central corner piece to form the right angle.

17. The system of claim 16, wherein the central corner piece comprises an arc portion of the continuous sheet, said portion joining the two bracket arms.

* * * * *